United States Patent [19]

Hart

[11] 4,439,379

[45] Mar. 27, 1984

[54] METHOD FOR THE CONTINUOUS MANUFACTURE OF FINELY DIVIDED METALS, PARTICULARLY MAGNESIUM

[76] Inventor: Robert J. Hart, 190 Briarwood Crossing, Cedarhurst, N.Y. 11516

[21] Appl. No.: 462,628

[22] Filed: Jan. 31, 1983

Related U.S. Application Data

[62] Division of Ser. No. 244,249, Mar. 16, 1981, Pat. No. 4,374,633.

[51] Int. Cl.[3] ..... B01J 2/04
[52] U.S. Cl. ..... 264/12
[58] Field of Search ..... 264/12

[56] References Cited

U.S. PATENT DOCUMENTS

| | | | |
|---|---|---|---|
| 3,462,248 | 8/1969 | Roberts et al. | 264/12 |
| 3,963,811 | 6/1976 | Tamura et al. | 264/7 |
| 4,238,427 | 12/1980 | Chisholm | 264/7 |
| 4,359,434 | 11/1982 | Tiberg | 264/7 |

*Primary Examiner*—James R. Hall
*Attorney, Agent, or Firm*—Ronald G. Goebel

[57] ABSTRACT

A method for continuously manufacturing finely divided magnesium, and similar metals, in which a liquid stream of magnesium ejected from a nozzle is impacted by a high velocity stream of inert gas to "atomize" the liquid magnesium, including the intermittent entrainment of an abrasive powder in the inert gas stream to remove the build-up of solid magnesium or magnesium compounds that otherwise would collect on the end of the nozzle and interfere with continuous operation of the "atomizing" process.

5 Claims, 6 Drawing Figures

FIG. 2
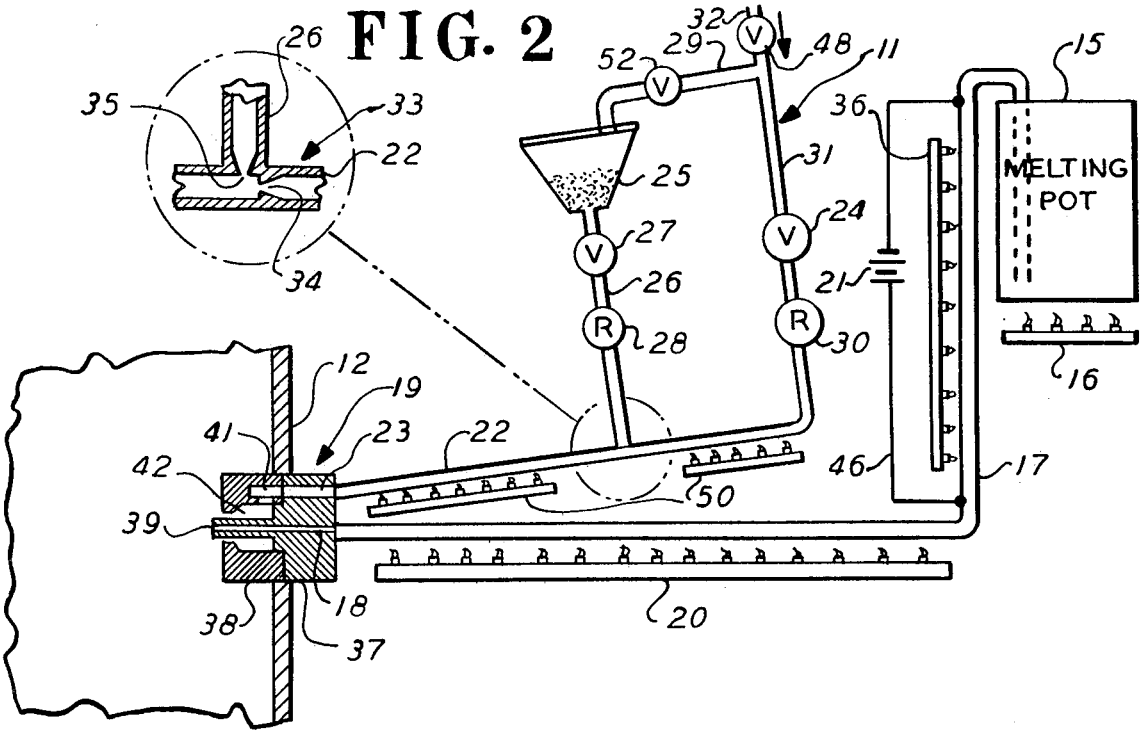
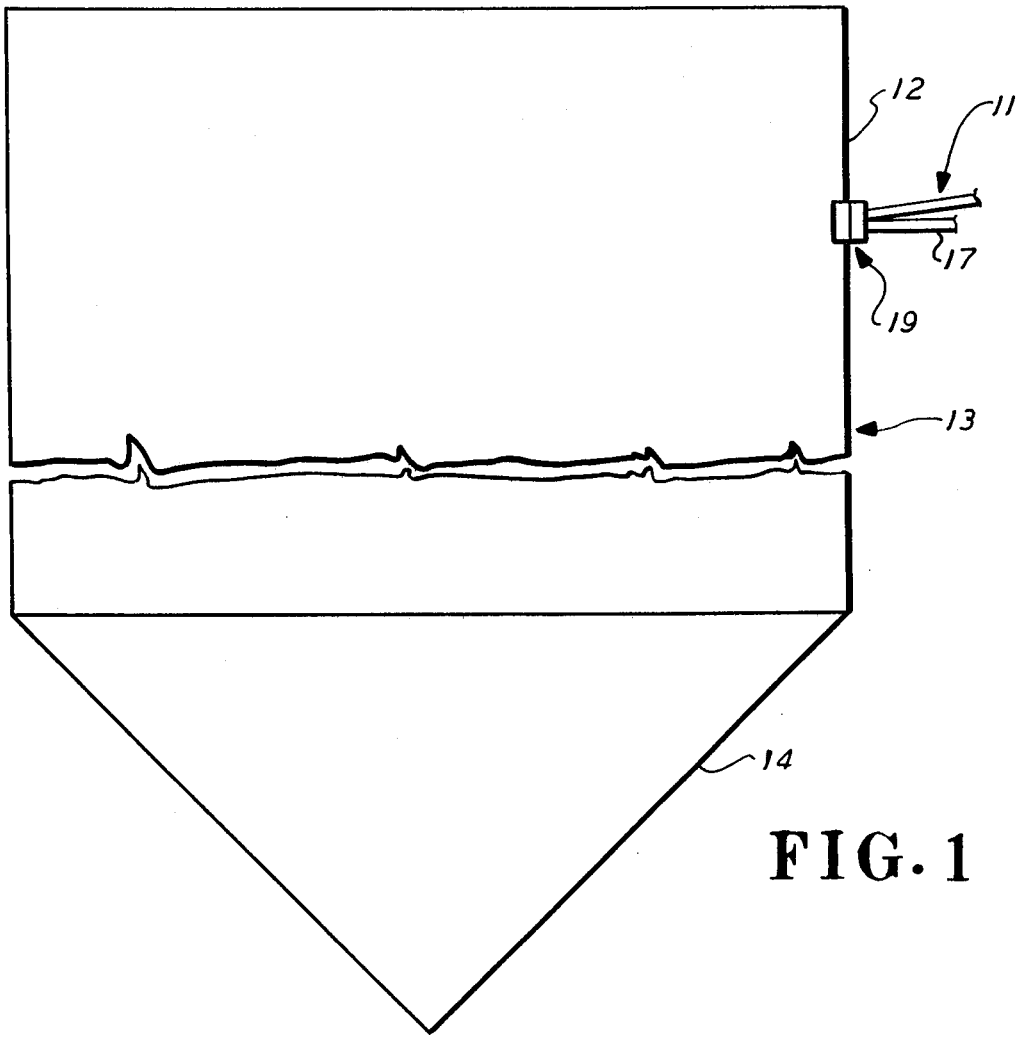
FIG. 1

METHOD FOR THE CONTINUOUS MANUFACTURE OF FINELY DIVIDED METALS, PARTICULARLY MAGNESIUM

This is a division of application Ser. No. 244,249, filed Mar. 16, 1981, now U.S. Pat. No. 4,374,633, issued Feb. 22, 1983.

BACKGROUND OF THE INVENTION

The manufacture of finely divided magnesium (i.e. "atomized" magnesium) for use in pyrotechnic devices such as flares, military applications and other purposes is well known. One process used is to eject a stream of liquid magnesium from a nozzle and then to hit the liquid magnesium stream, as it issues from the nozzle, with a high velocity jet of inert gas, such as helium. The impact of the helium jet on the liquid magnesium stream breaks the liquid stream into very finely divided droplets which, when passed into a large chamber containing the inert gas, cool in said chamber to form solid magnesium powder of such fineness as to be commonly referred to as "atomized" magnesium.

Such a process, however, could not, prior to the present invention, be operated continuously because some of the liquid magnesium issuing from the nozzle would after a period of operation deposit and collect in solid form on the end of the nozzle, which in turn would interfere with and disrupt the inert gas jet to an extent such that the operation would have to be discontinued.

Shut-down of the apparatus to remove the build-up on the nozzle is time consuming and expensive. Once the operation is interrupted for any length of time the liquid magnesium cools and solidifies in the lines.

SUMMARY OF THE INVENTION

According to the present invention, a magnesium powder manufacturing process is provided in which build-ups on the atomizing nozzle may be removed during operation, from time to time without stopping the flow of inert gas or liquid metal, and by means which does not contaminate the resultant powdered magnesium product.

When a nozzle build-up is seen or otherwise sensed, an abrasive powder (preferably magnesium oxide powder) is injected into the inert gas stream in such amount and for such period as to wear off or knock off the solid build-up (primarily solid magnesium) around the end of the nozzle. Thus the build-up is removed before it interferes with the operation and the apparatus can be operated continuously, without having to be shut down on account of solid build-up of magnesium or a magnesium compound (such as magnesium oxide or nitride) on the nozzle.

The process of this invention can also be applied to alloys of magnesium containing at least about 60% by weight of magnesium. One such alloy is a magnesium aluminum alloy containing 65% by weight magnesium and 35% by weight aluminum which is used in the steel industry for desulfurization. Other alloys include magnesium zinc, magnesium nickel, magnesium-calcium alloys containing at least about 60% by weight magnesium.

Furthermore, no impurities or contaminants are introduced into the final product because the preferred abrasive, magnesium oxide, introduced only in very small quantity and for short times is merely the oxidized form of the metal powder being manufactured.

BRIEF DESCRIPTION OF THE DRAWINGS

FIG. 1 shows a typical nozzle assembly of the apparatus according to the invention mounted in the sidewall of a magnesium powder collecting tank for manufacturing atomized magnesium by projecting a horizontal spray of magnesium into the collecting tank. The nozzle assembly could alternatively be mounted in the topwall of the tank, for vertical spray applications or at any other convenient angle of spray.

FIG. 2 shows an apparatus for carrying out the invention mounted in a wall of magnesium collecting tank as in FIG. 1. The nozzle assembly is shown in cross-section and an exploded view of the cross-section of the junction of the abrasive material conduit and the pressurized gas conduit is included.

DETAILED DESCRIPTION OF THE PREFERRED EMBODIMENTS

Figure 3:
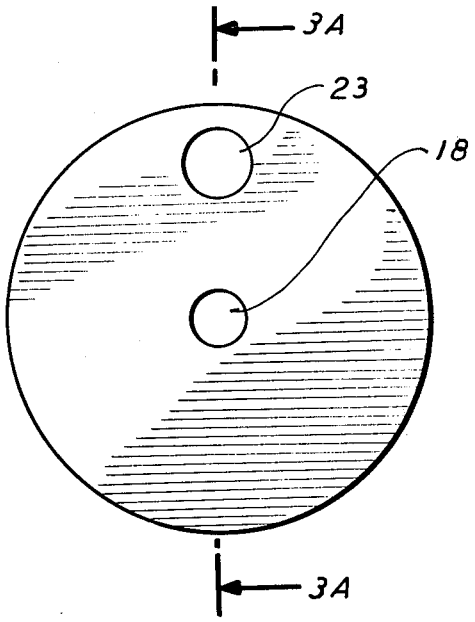
FIG. 3 is a right side view of the nozzle assembly of the apparatus of FIG. 2.

Referring to FIGS. 1 & 2, an apparatus, shown generally by 11, comprises a nozzle assembly 19 mounted in a sidewall 12 of collecting tank 13. The tank 13 has a lower conical section 14 in which the finely divided or atomized magnesium powder settles to be later withdrawn through a sealed port or opening (not shown) at the bottom of the tank.

The apparatus 11 also includes (FIG. 2) a melting pot 15 into which is introduced magnesium metal. Means for melting the magnesium metal such as fuel gas burners 16 are located beneath pot 15. A pipe 17 having an inlet opening beneath the surface of the liquid magnesium in melting pot 15 leads from the top of melting pot 15 downwardly below the level of the melting pot to inlet 18 of nozzle assembly 19 mounted in sidewall 12 of tank 13. Heating means such as burners 20 and 36 are located below and alongside a section of pipe 17 between the melting pot 15 and nozzle assembly 19. An electrical resistance heater 21 also may be provided, if desired. Inert gas from a pressurized source (not shown) located externally of tank 13 is also fed from inlet 32 through conduits 31 and 22 to inert gas inlet 23 of the nozzle assembly. Flow control valve 48 in conduit 32 regulates gas flow from the source to the nozzle assembly.

A reservoir 25 containing an abrasive material located above conduit 22 is connected by conduit 29 to conduit 32 and by conduit 26 to conduit 22.

Conduit 26 extends from the bottom of reservoir 25 to the conduit 22 and it has inserted therein an "on" and "off" valve 27 and a metering orifice valve 28 for regulating the rate of flow of abrasive material from the reservoir into the conduit 22. A positive pressure is maintained in the top section of reservoir 25, above the powdered abrasive material in said reservoir. A valve 52 controls the flow of gas through conduit 29.

The inert gas flowing through conduit 31 and the abrasive laden inert gas flowing through conduit 22, are heated (for example to about 1000 degrees F. by burners 50).

FIG. 2 additionally shows an exploded cross-sectional view of the union 33 of conduits 26 and 22. The internal diameter of conduit 22 is constricted at 34 so that a pressure drop will occur in conduit 22 at its intersection with conduit 26 as gas is ejected from the constriction, thus effecting aspiration of abrasive through conduit 26. Conduit 26 is also constricted at 35 to further control the flow of abrasive material through conduit 26.

Figure 3A:
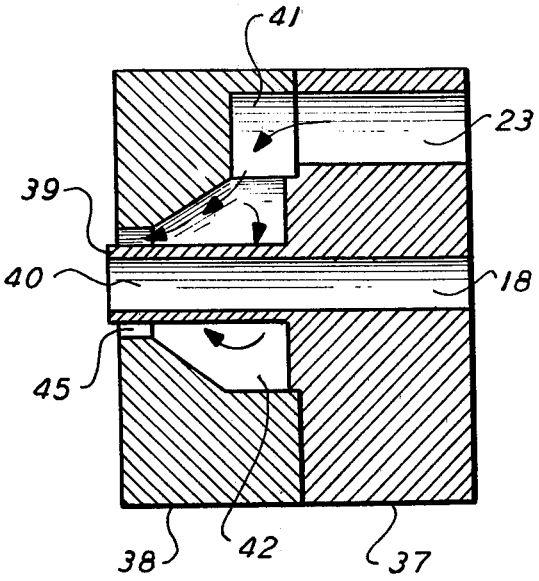
FIG. 3A is a sectional view of the nozzle assembly of FIG. 3 taken along line 3A—3A of FIG. 3.
Figure 4:
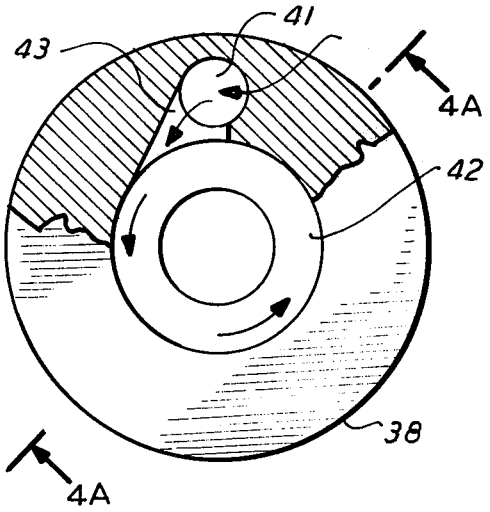
FIG. 4 is a left side view, partly in section, of the nozzle assembly.
Figure 4A:
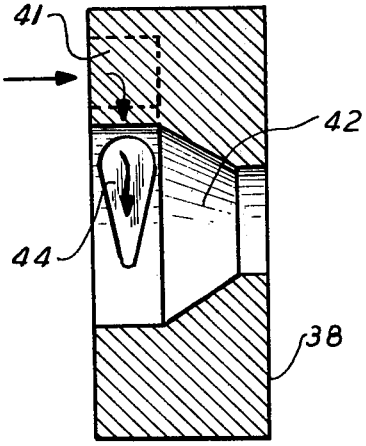
FIG. 4A is a sectional view of the outlet section of the nozzle assembly of FIG. 4 taken along lines 4A—4A of FIG. 4.

The nozzle assembly 19 of FIG. 2 includes two engageable cylindrical sections; inlet section 37 and outlet section 38 shown in detail in FIGS. 3, 3A, 4 and 4A. Inlet section 37 is provided with a central liquid magnesium inlet 18 and an offset inert gas inlet 23 which are connected with conduits 17 and 22 respectively, as hereinbefore described. A nozzle 39 projects from the inlet section 37 and it has a bore 40 which communicates with and is an extension of inlet opening 18 of inlet section 37. Outlet section 38, as shown in FIG. 3A and in more detail in FIGS. 4 & 4A, is provided with a gas receiving chamber 41 which connects with gas inlet 23 of section 37 and also with an annular chamber 42 communicating with chamber 41 and surrounding nozzle 39. This annular chamber 42 is constricted in the area of the nozzle outlet, forming a narrow gas outlet annulus 45. Between gas receiving chamber 41 and annular chamber 42 is a connecting passage 43 (FIG. 4). The arrows shown in FIGS. 3A, 4 and 4A show the path of inert gas flow from inlet opening 23 through the chambers 41, passage 43, chamber 42 to the outlet annulus 45 of the outlet section. A portion of the wall of connecting passage 43 is grooved as shown in 44, the groove being wider and deeper in the vicinity of chamber 41 and narrower and shallower in the vicinity of the central portion of annular chamber 42. This tapered groove imparts a swirling motion to the inert gas received in chamber 41 from inlet 23 and discharged from chamber 41 into the annular chamber 42 and through the inert gas jet opening 45.

In operation of the apparatus of the invention to produce "atomized" magnesium, magnesium metal is placed in melting pot 15 and in pipe 17 and then heated to melting by burners 16, 20 and 36. Because the inlet to pipe 17 is located below the surface of the magnesium after the same liquifies, the liquid magnesium will then start to flow through pipe 17 by a siphoning action. The liquified magnesium flows by gravity through conduit 17 to the nozzle inlet 18 of nozzle assembly 19 and on out through nozzle 39. The continuity of molten magnesium flow can be maintained solely by the siphoning action or maintained by a pump (not shown) as desired. Alternatively, or in addition, flow of liquid magnesium from pot 15 through line 17 and nozzle 39 may be assisted or maintained by pressurizing pot 15 with inert gas. The liquid magnesium in pot 15 is preferably maintained at a temperature of about 1425 degrees F. Burners 20 and 36 insure that the molten magnesium will not solidify in line 17, which is open throughout its length and thus provides for continuous flow of magnesium metal through line 17 and out nozzle 39 so long as molten magnesium is maintained at the proper level in pot 15. At the same time, pressurized gas flows through line 31 to gas inlet 23, enters receiving chamber 41, is directed inwardly through connecting passage 43 and notch 44 into annular chamber 42 where it swirls at high velocity around nozzle 39 and is ejected as a swirling jet at high velocity through annular gas outlet 45 into the tank. The ejected gas impinges upon the ejected molten magnesium stream from nozzle 39 and atomizes the magnesium into a spray of finely divided droplets inside tank 13.

There are no valves in the liquid magnesium line so the flow is continuous so long as liquid metal is maintained in the pot with its surface above the inlet to line 17 (when a siphoning feed is utilized). However, the inert gas flow is regulated by a pressure control regulator 30 in line 31, and the flow of abrasive powder (such as magnesium oxide) from reservoir 25 downwardly into inert gas conduit 22 is regulated by a flow regulating valve or metering orifice 28.

Reservoir 25 has a cover so that the inert gas introduced therein through by-pass line 29 can be maintained (in the top section of the reservoir above the abrasive powder) at a pressure sufficient to enable the abrasive powder to flow downwardly through conduit 26 and to be entrained in the inert gas flowing to gas jet nozzle opening 45 through conduit 22. Such flow is insured by a positive pressure above the abrasive material level maintained by pressure from inlet 32 via equalizing line 29. Abrasive material in conduit 26 is aspirated by and mixed with the pressurized gas in conduit 22 at junction 33 of these two conduits. The abrasive material, mixed with the gas, contacts and abrades the solidified magnesium on the nozzle or on the sides of the orifice 45 until it is completely removed. The abrasive material ejected into tank 12 with the gas, molten magnesium and solidified magnesium becomes a minor impurity in the total yield of atomized magnesium.

After the build-up on nozzle 39 or on the sides of orifice 45 is removed, valve 27 is closed and the atomization process continues as before without interruption. In practice the abrasive material can be introduced to the system at regular intervals to ensure that no significant build-up of solid magnesium occurs at the nozzle.

The abrasive material used in this invention can be any particulate material which has abrasive properties and does not react with magnesium such as silica, sand, carborundum, aluminum oxide and the like. Preferably, however, magnesium oxide (magnesite) is employed as the abrasive material. By using the oxidized form of the metal being atomized, i.e. magnesium, contamination of the so-formed atomized magnesium is substantially eliminated.

Once liquid magnesium is ejected into tank 13 from nozzle 39 simultaneously with the ejection of a high velocity stream of swirling helium from nozzle 45, the gas jet impinges forcefully on the liquid metal and causes it to break up into very finely divided droplets, in the form of a "spray", which is projected into the helium atmosphere in the tank 13. The droplets then cool and solidify while suspended in the helium gas, to form "atomized" magnesium particles which settle by gravity to the bottom of the tank, from which they are removed.

During the operation as described above small amounts of magnesium and/or magnesium compounds may solidify or otherwise deposit on or around the edge of the liquid metal nozzle 39 or on the side of orifice 45 against outlet section 38. If this deposit accumulates to a degree disrupting the flow or shape of the inert gas jet issuing from gas nozzle 45, there will be an adverse effect on the size or uniformity or other characteristics of the magnesium particles being formed and collected in the tank and when this happens the said deposit must be removed without interrupting the operation and without introducing impurities into the final product.

This removal is effected by opening valve 27 and allowing magnesium abrasive powder (magnesium oxide) from reservoir 25 to flow downwardly through conduit 26 into the inert gas stream flowing through line 22. When the gas containing such abrasive issues from orifice 45 and impinges upon the edges of this orifice upon which the deposit has accumulated, the deposit is broken off or worn away by the abrasive until it disappears to the point where the orifice is free of deposit and the operation once again can proceed normally, as originally begun.

Only a relatively "short burst" of abrasive powder is required, and the abrasive normally is introduced only at intervals so that the operation is predominately carried out so that only pure magnesium is introduced into the tank, of the same purity placed in the melting pot 15.

When a burst of abrasive powder is fed into the inert gas stream passing through conduit 22, the abrasive ends up in tank 13, and could become an "impurity" in the final product. However, the use of magnesium oxide as the abrasive provides an end product that is completely magnesium except for very small amounts of oxygen combined with a very small amount of the magnesium in the oxide form. The result is that for practical purposes for which it is used, substantially pure magnesium powder, completely absent of any detrimental impurities is produced.

The method of the invention may be used to produce atomized particles of magnesium alloys containing at least 60% by weight of magnesium such as a 65% by weight magnesium—35% by weight aluminum alloy and other alloys of magnesium.

In order more particularly to describe and illustrate the present invention, the following examples are given of two applications of the invention. These examples are not to be considered as limiting, but only as typical of certain of the actual applications of the present invention. In each example the apparatus of FIGS. 1 to 4A was employed.

SPECIFIC EXAMPLES

Example 1

In this Example, magnesium in pot 15 was heated to 1400° F. and caused to flow in conduit 17 to nozzle assembly 19 at a pressure of 27 inches of water. Helium gas in line 32 at 100 psig was also introduced to the nozzle assembly at 250 scfm. The nozzle diameter was 0.300 inches and the diameter of the gas outlet annulus 45 was 0.400 inches. The atomizing rate of magnesium from the nozzle was about 300 pounds per hour. At intervals of about 20 minutes during atomization, about 1 pound of silica sand in reservoir 25 was introduced into conduit 22 to completely clear obstructions from the nozzle. The total magnesium powder produced was 2520 pounds.

Example 2

In this Example, magnesium in pot 15 was heated to 1410° F. and caused to flow in conduit 17 to nozzle assembly 19 at a pressure of 27 inches of water. Helium gas was again employed at a pressure of 60 psig and a flow rate of 240 scfm. The nozzle diameter was 0.350 inches and the diameter of the gas outlet annulus 45 was 0.450 inches. The atomizing rate of magnesium from the nozzle was 400 pounds per hour. At eight times during the atomization, about 6½ ounces of magnesite (60 mesh) from reservoir 25 was introduced into conduit 22 to remove magnesium build-up at the nozzle. The total atomized magnesium produced was 1600 pounds.

What is claimed is:

1. A method for manufacturing finely divided particles of magnesium comprising:

(a) projecting a stream of molten magnesium into an enclosed chamber containing a gaseous atmosphere inert to said magnesium;

(b) projecting at a velocity exceeding that of the magnesium a stream of inert gas to contact and atomize said magnesium stream into a spray of finely divided droplets, said droplets being dispersed and cooled by said inert gas within said chamber to solidification; and (c) entraining in said inert gas stream prior to contact with said magnesium stream a finely divided abrasive particulate comprising an oxide of magnesium which combines with said formed droplets and said solid magnesium particles.

2. The method of claim 1 wherein said inert gas is selected from the group consisting of helium and argon, said stream of molten magnesium issuing from a nozzle having a tip and said gas stream being positioned to strike the tip of said nozzle and said magnesium stream to atomize said magnesium stream into said finely divided droplets.

3. A method for manufacturing finely divided particles of a magnesium alloy comprising:

(a) projecting a stream of molten magnesium alloy into an enclosed chamber containing a gaseous atmosphere inert to said magnesium alloy;

(b) projecting at a velocity exceeding that of the magnesium alloy a stream of inert gas to contact and atomize said magnesium alloy stream into a spray of finely divided droplets, said droplets being dispersed and cooled by said inert gas within said chamber to solidification; and (c) entraining in said inert gas stream prior to contact with said magnesium alloy stream a finely divided abrasive particulate comprising an oxide of magnesium which combines with said formed droplets and said solid magnesium particles.

4. The method of claim 3 wherein said magnesium alloy contains at least 60% by weight of magnesium.

5. The method of claim 3 wherein said magnesium alloy is an alloy of magnesium and aluminum containing about 65% by weight magnesium and 35% by weight aluminum.

* * * * *